US005355785A

United States Patent [19]

Pera et al.

[11] Patent Number: 5,355,785

[45] Date of Patent: Oct. 18, 1994

[54] DEJUICER FOR DEJUICING HARVESTED GRAPES

[75] Inventors: Didier Pera, Montblanc; Jean Pera, Cap d'Agde, both of France

[73] Assignee: Somavi, Florensac, France

[21] Appl. No.: 164,637

[22] Filed: Dec. 9, 1993

Related U.S. Application Data

[63] Continuation of Ser. No. 927,211, Aug. 6, 1992, abandoned.

[30] Foreign Application Priority Data

Aug. 12, 1991 [FR] France ..... 91 10240

[51] Int. Cl.[5] ..... B30B 9/22

[52] U.S. Cl. ..... 99/495; 100/211; 100/116; 99/513

[58] Field of Search ..... 99/495, 510, 509, 513; 100/211, 116, 125

[56] References Cited

U.S. PATENT DOCUMENTS

| | | | |
|---|---|---|---|
| 4,106,404 | 8/1978 | Schmid | 100/211 |
| 4,313,375 | 2/1982 | Saalasti | 100/211 |
| 4,438,690 | 3/1984 | von Allworden | 100/211 |
| 4,513,659 | 4/1985 | Braun | 100/211 |
| 4,607,570 | 8/1986 | Hauser | 99/495 |
| 5,081,921 | 1/1992 | Gregoire | 100/211 |

FOREIGN PATENT DOCUMENTS

| | | | |
|---|---|---|---|
| 0341098 | 11/1989 | European Pat. Off. . | |
| 2524112 | 12/1976 | Fed. Rep. of Germany . | |
| 3440558 | 5/1986 | Fed. Rep. of Germany | 99/495 |
| 2246384 | 5/1975 | France . | |

*Primary Examiner*—David A. Scherbel
*Assistant Examiner*—Reginald L. Alexander
*Attorney, Agent, or Firm*—Remy J. VanOphem

[57] ABSTRACT

A grape dejuicer comprises a closed tank provided with a dejuicer grid and a membrane in the tank which is pressurized to force juice out of the harvested grapes through the grid. Conveyor means in the tank remove the dejuicer grapes from the tank. Harvested grapes are placed in said tank and the juice is allowed to flow naturally. The membrane is then pressurized to force out further juice through the grid. The membrane is then depressurized and the tank is emptied by actuating the conveyor means.

19 Claims, 2 Drawing Sheets

DEJUICER FOR DEJUICING HARVESTED GRAPES

This is a continuation of application Ser. No. 07/927,211, filed Aug. 06, 1992 now abandoned.

The invention concerns the dejuicing of harvested grapes.

It is known that so-called "static" dejuicing is effected by placing the harvested grapes in a tank having a grid at the bottom through which the juice is allowed to flow naturally. This removes the first 30 to 50% of the liquid content of the harvested grapes.

Sometimes additional, so-called "dynamic" dejuicing is then employed in which the harvested grapes are moved along a grid, usually by an endless screw. 70 to 80% of the initial liquid content of the harvested grapes is removed by static dejuicing followed by dynamic dejuicing.

To extract more than this 70 to 80% of the juice, instead of further dejuicing an extremely vigourous mechanical pressing action is applied to the harvested grapes to obtain the so-called "press juice", as opposed to the so-called "juice from dejuicing" obtained by dejuicing.

The invention is directed to the production of a high-quality juice from dejuicing with a high yield using a simple and easy to use dejuicer.

To this end it proposes a dejuicer for harvested grapes comprising a closed tank provided with a dejuicer grid; characterized in that it further comprises a membrane disposed in the tank, adapted to be pressurized to force dejuicing of the harvested grapes through the grid; and conveyor means disposed in the tank to remove the dejuiced grapes from the tank.

When the dejuicer in accordance with the invention is employed by first allowing the juice to flow naturally and then by forcing the flow by means of the membrane, the final percentage extraction is comparable with that achieved by static dejuicing followed by dynamic dejuicing, that is to say a high yield.

By employing forced static dejuicing rather than dynamic dejuicing all of the juice is extracted without masticating the harvested grapes, the result of which is to produce a particularly clear, that is to say very high quality, juice.

The dejuicer in accordance with the invention is simple and convenient to use, not only because filling the tank and extracting the juice do not pose any problems but also because it comprises built-in conveyor means which merely need to be actuated when all the juice extraction operations have been finished to remove from the tank the dejuiced grapes, that is to say the pomace.

According to preferred features of the invention the conveyor means are disposed against a wall above which is the lowest part of the interior volume of the tank.

The harvested grapes introduced into the tank therefore cover the conveyor means, which are in the bottom part, the wall against which they are placed supporting the conveyor means to assist them to withstand, in addition to the weight of the harvested grapes, the additional force due to the pressurisation of the membrane. The latter is additionally isolated from the conveyor means by the harvested grapes so that there is no risk of it being damaged by the edges of the conveyor means. This arrangement of the conveyor means is therefore advantageous from the points of view of the reliability and the durability of the dejuicer.

According to other preferred features of the invention the dejuicer comprises juice from dejuicing recovery means which communicate with the interior volume of the tank above the lowest part of said interior volume.

The juice in the tank up to a certain height above its lowest part will therefore not be recovered as juice from dejuicing, which is favorable to the quality of the juice from dejuicing obtained because this prevents it including the sediment usually found in the tank bottom.

According to other preferred features favorable to the simple, reliable and economical nature of the dejuicer:

the tank has an interior volume delimited:

by a solid wall above which is the lowest part of the interior volume of the tank; and by a dejuicer grid on each side above the solid wall behind which is a juice from dejuicing recovery chamber;

said conveyor means comprise at least one endless screw;

said conveyor means comprise two endless screws separated by a projecting portion of said wall;

said membrane forms a closed bag and is suspended from a rod disposed longitudinally in the upper part of the interior volume of the tank;

the membrane is supplied with pressurizing agents through the rod, which is hollow;

the membrane is elastic.

The invention also proposes a method of dejuicing harvested grapes characterized in that it uses a dejuicer as defined above with the following steps:

the harvested grapes are placed in the tank;

the juice is allowed to flow out naturally;

the membrane is pressurized in the tank to force juice to flow through the grid;

the membrane is depressurized; and the tank is emptied by actuating the conveyor means.

According to preferred features in some kinds of vinification after the harvested grapes are placed in the tank they are allowed to macerate there before extraction of the juice is started.

This causes pellicular maceration which by virtue of the prolonged contact between the grape skin and the liquid enables extraction of important flavoring agents contained in the grape skin. With some types of grape this further improves the quality of the juice from dejuicing obtained.

The disclosure of the invention will now continue with the description of one embodiment by way of nonlimiting illustrative example with reference to the appended highly diagrammatic drawings, in which:

FIG. 1 is an elevation view in transverse cross-section of a dejuicer in accordance with the invention when empty;

FIG. 2 is an elevation view of it longitudinal cross-section; and

FIGS. 3 and 4 are views similar to FIG. 1 respectively after the tank is filled with the harvested grapes and after the membrane is pressurized.

The dejuicer shown comprises a generally cylindrical closed tank 1 with a horizontal axis and feet 2 resting on the ground.

The tank has a cylindrical lateral wall 3 joined at each end to a respective transverse end wall 4A and 4B. A solid wall 5 delimiting two longitudinal channels separated by a protruding portion 6 is attached between the walls 4A and 4B and above the lower portion of the wall 3, the lowest portion of the interior volume of the tank corresponding to the bottom of each of these channels. On each side of the wall 5, to a certain height, the interior volume of the tank is also delimited by a respective dejuicer grid 7A and 7B attached between the walls 4A and 4B and substantially parallel to the wall 3. Above the grids 7A and 7B the interior volume of the tank is delimited by the wall 3 directly. The space between the grid 7A or 7B and the wall 3 constitutes a respective juice from dejuicing recovery chamber 8A or 8B whose bottom is connected to a juice from dejuicing recovery pipe 9A or 9B fitted with a shut-off valve (not shown). A wall 10A or 10B isolates the chamber 8A or 8B from the space 11 situated between the walls 3 and 5. At each end of the channel delimited by the wall 5 is a trapdoor 12 in the wall 4A for removing the pomace. Two openings 13 in the upper part of the wall 3 for loading the harvested grapes are connected to a feed pipe 14. A trapdoor 15 is disposed substantially at the center of the wall 4A to provide access to the interior of the tank for installation of its interior fittings and subsequently for maintenance.

A respective endless screw 16A and 16B is placed against the wall 5, to be more precise against each of its parts forming a channel. At the same end of the wall 4A the endless screw faces the trapdoor 12, while it has a shaft extending beyond the wall 4B carrying a drive pulley connected by a belt to a motor (not shown) adapted to rotate the screw as shown by the arrow.

A membrane 18, made from an elastic material in this embodiment, forming a closed bag is suspended from a rod 19 disposed longitudinally in the upper part of the interior volume of the tank. The rod 19 is hollow (it is a tube) and supplies a pressurizing agent such as compressed air to the membrane. Here (see FIG. 2) the rod 19 goes inside the membrane. 18 and comprises 5 holes through which the pressurizing agent enters or leaves the membrane.

The operation of the dejuicer shown will now be described.

Starting from the empty position shown in FIG. 1 with the trapdoors 12 and 15 closed and the valves on the pipes 9A and 9B closed, the harvested grapes to be treated are fed through the pipes 14 and the openings 13 into the interior volume of the tank 1 until they fill the tank, at the end of which operation the membrane. 18 floats on top of the harvested grapes so to speak (see FIG. 3).

Either immediately or after a few hours of maceration in the closed space constituted by the interior volume of the tank the juice from dejuicing extraction phase begins: the valves on the pipes 9A and 9B are opened and the juice flows naturally, and after some time the flowrate decreases.

At this moment the pressurizing agent is fed into the membrane which inflates, the grapes already dejuiced naturally are compressed (FIG. 4) which forces them to dejuice further, the juice begins to flow again and then the flowrate gradually decreases to zero, the compressed grapes blocking the grids 7A and 7B. This completes the juice extraction phase.

The membrane 18 is then depressurized, the trapdoors 12 are opened and the endless screws 16A and 16B are made to rotate to remove the dejuiced grapes, that is to say the pomace, from the tank. The membrane reverts to its initial shape and position of its own accord because of its elasticity and because it is suspended from the rod 19.

Note that there the harvested grape feed openings 13 are to the side relative to the rod 19 which enables the membrane to remain above the harvested grapes (see FIG. 3).

Here it has been beneficial to use two endless screws because of the diameter of the cylindrical wall 3 but in embodiments with different diameters a single endless screw or more than two endless screws is or are used.

Endless screws are conveyor means particularly suited to the dejuicer in accordance with the invention with regard to both ruggedness and efficiency, but in some variants, especially of parallelepiped shape, the endless screws may be replaced with transverse bars driven by endless chains, scraping the bottom of the interior volume of the tank.

More generally, the invention is not limited to the examples described but to the contrary encompasses all variants thereof that may be determined by the man skilled in the art.

We claim:

1. A device for dejuicing harvested grapes and collecting the juice therefrom, said device comprising:

an immobile closed tank having a first end and an opposite end, said immobile closed tank further having an inner surface defining an internal chamber, said inner surface of said immobile closed tank having at least one food opening located therein, said immobile closed tank further having at least one discharge opening located in said first end of said immobile closed tank;

at least one dejuicing grid spaced a predetermined distance from said inner surface of said immobile closed tank;

a membrane located within said internal chamber;

means for mounting said membrane separate from said inner surface of said immobile closed tank, said membrane further being adapted to be pressurized;

means for collecting said juice of said dejuiced grapes, said collecting means being located adjacent said dejuicing grid, said means for collecting receiving said juice from said harvested grapes; and means for removing said dejuiced harvested grapes from said immobile closed tank, said removing means being located within said immobile closed tank;

whereby after said harvested grapes are loaded into said internal chamber of said immobile closed tank through said at least one feed opening, said membrane is pressurized to apply pressure to said harvested grapes to dejuice said harvested grapes such that said juice flows through said at least one dejuicing grid and into said collecting means and whereafter said membrane is depressurized and then said removing means is actuated to remove said dejuiced harvested grapes from said immobile closed tank.

2. The device according to claim 1 wherein said immobile closed tank at said first end comprises a solid wall surrounding said at least one discharge opening and further wherein said means for removing said dejuiced harvested grapes is disposed adjacent said solid wall which is the lowest part of the interior volume of said immobile closed tank.

3. The device according to claim 2 wherein said means for collecting said juice from said dejuiced harvested grapes communicates with said internal chamber of said immobile closed tank.

4. The device according to claim 1 wherein said immobile closed tank at said first end comprises a slid wall defining the lowest part of the interior volume of said immobile closed tank; and further wherein said at least one dejuicing grid has a first lower end portion attached to said solid wall and a second opposite end portion attached to said inner surface of said immobile closed tank to define a dejuicing recover chamber.

5. The device according to claim 1 wherein said means for removing said dejuiced harvested grapes comprises at least one endless screw.

6. The device according to claim 4 wherein said means for removing said dejuiced harvested grapes comprises two endless screws separated by a protruding portion of said solid wall.

7. The device according to claim 1 further comprising a hollow rod disposed longitudinally in the upper part of the interior volume of said immobile closed tank near said inner surface; and further wherein said membrane forms a closed bag having one end surrounding said hollow rod.

8. The device according to claim 7 further comprising means for pressurizing said membrane, said pressurizing means communicating with said membrane through said hollow rod.

9. The device according to claim 8 wherein said membrane is elastic.

10. A device for dejuicing harvested grapes, said device comprising:

an immobile closed tank defining an internal chamber having an inner surface, said immobile closed tank having provided internally a membrane and a conveyor means both located in said internal chamber, said internal chamber having at least one feed opening, a dejuicing grid and a discharge opening;

means for mounting said membrane separate from said inner surface of said internal chamber, said membrane being adapted to be pressurized so as to force juice from said harvested grapes, placed beforehand in said internal chamber, through said dejuicing grid;

said at least one feed opening being adapted to introduction of said harvested grapes in said tank directly into said internal chamber so that said harvested grapes can be placed in said chamber and then dejuiced through said dejuicing grid while said conveyor means remain inoperative;

said conveyor means being adapted to remove said harvested grapes from said immobile closed tank through said discharge opening; and said immobile closed tank being provided externally with feet for resting said immobile closed tank on the ground.

11. The device according to claim 10 further comprising a wall delimiting a lowermost portion of said internal chamber and further wherein said conveyor means is disposed against said wall in said lowermost portion of said internal chamber.

12. A dejuicer according to claim 11 wherein said wall has a protruding portion and further wherein said conveyor means comprises two endless screws separated by said protruding portion of said wall.

13. A dejuicer according to claim 10 further comprising juice recovery means which communicates with said internal chamber above a lowermost portion of said internal chamber.

14. A dejuicer according to claim 10 wherein said internal chamber further comprises:

a solid wall having a side, said solid wall defining a lowermost portion of said internal chamber; and wherein said dejuicing grid is located adjacent said side of said solid wall.

15. A dejuicer according to claim 10 wherein said conveyor means comprises at least one endless screw.

16. A dejuicer according to claim 10 further comprising a rod mounted longitudinally in said internal chamber and further wherein said membrane forms a closed bag and is suspended from said rod.

17. A dejuicer according to claim 16 wherein said rod is hollow and wherein said membrane is supplied with a pressurizing agent by said rod.

18. A dejuicer according to claim 16 wherein said membrane is elastic.

19. A dejuicer according to claim 16 wherein said at least one feed opening is offset with respect to said rod.

* * * * *
* * * * *

UNITED STATES PATENT AND TRADEMARK OFFICE

CERTIFICATE OF CORRECTION

PATENT NO. : 5,355,785

DATED : October 18, 1994

INVENTOR(S) : Pera et al

It is certified that error appears in the above-indentified patent and that said Letters Patent is hereby corrected as shown below:

Title page, item [57], and Columns 1 through 6, delete in their entirety and substitute with the attachment.

Signed and Sealed this

Third Day of October, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,355,785

DATED : October 18, 1994

INVENTOR(S) : Pera, et al

It is certified that error appears in the above-indentified patent and that said Letters Patent is hereby corrected as shown below:

Title page, item [57], and Columns 1 through 6, delete in their entirety and substitute with the attachment.

This certificate supersedes Certificate of Correction issued October 3, 1995.

Signed and Sealed this

Twelfth Day of December, 1995

*Attest:*

Bruce Lehman

BRUCE LEHMAN

*Attesting Officer*

*Commissioner of Patents and Trademarks*

United States Patent [19]

Pera et al.

[11] Patent Number: 5,355,785

[45] Date of Patent: Oct. 18, 1994

[54] DEJUICER FOR DEJUICING HARVESTED GRAPES

[75] Inventors: Didier Pera, Montblanc; Jean Pera, Cap d'Agde, both of France

[73] Assignee: Somavi, Florensac, France

[21] Appl. No.: 164,637

[22] Filed: Dec. 9, 1993

Related U.S. Application Data

[63] Continuation of Ser. No. 927,211, Aug. 6, 1992, abandoned.

[30] Foreign Application Priority Data

Aug. 12, 1991 [FR] France ..... 91 10240

[51] Int. Cl.[5] ..... B30B 9/22

[52] U.S. Cl. ..... 99/495; 100/211; 100/116; 99/513

[58] Field of Search ..... 99/495, 510, 509, 513; 100/211, 116, 125

[56] References Cited

U.S. PATENT DOCUMENTS

| | | | |
|---|---|---|---|
| 4,106,404 | 8/1978 | Schmid | 100/211 |
| 4,313,375 | 2/1982 | Saalasti | 100/211 |
| 4,438,690 | 3/1984 | von Allworden | 100/211 |
| 4,513,659 | 4/1985 | Braun | 100/211 |
| 4,607,570 | 8/1986 | Hauser | 99/495 |
| 5,081,921 | 1/1992 | Gregoire | 100/211 |

FOREIGN PATENT DOCUMENTS

| | | | |
|---|---|---|---|
| 0341098 | 11/1989 | European Pat. Off. . | |
| 2524112 | 12/1976 | Fed. Rep. of Germany . | |
| 3440558 | 5/1986 | Fed. Rep. of Germany | 99/495 |
| 2246384 | 5/1975 | France . | |

*Primary Examiner*—David A. Scherbel
*Assistant Examiner*—Reginald L. Alexander
*Attorney, Agent, or Firm*—Remy J. VanOphem

[57] ABSTRACT

A harvested grape dejuicer constituted by a closed tank provided with a dejuicer grid and a membrane in the tank which is pressurized to force juice out of the harvested grapes through the grid. A conveyor in the tank removes the dejuiced grapes from the tank. Harvested grapes are placed in the tank and the juice is allowed to flow naturally. The membrane is then pressurized to force out further juice through the grid. The membrane is then depressurized and the tank is emptied by actuating the conveyor.

19 Claims, 2 Drawing Sheets

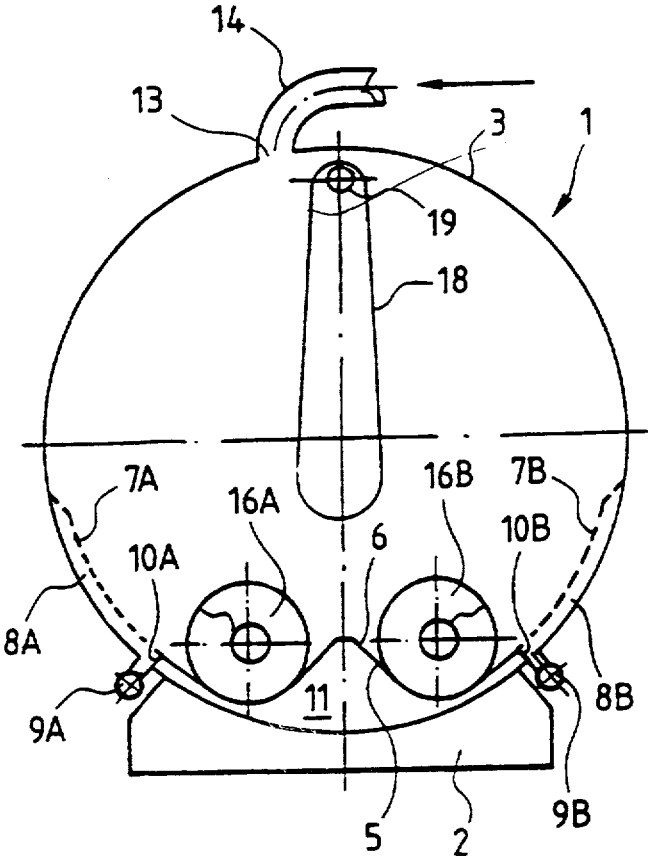

DEJUICER FOR DEJUICING HARVESTED GRAPES

BACKGROUND OF THE INVENTION

The invention concerns the dejuicing of harvested grapes.

It is known that so-called "static" dejuicing is effected by placing the harvested grapes in a tank having a grid at the bottom through which the juice is allowed to flow naturally. This removes the first 30 to 50% of the liquid content of the harvested grapes.

Sometimes additional, so-called "dynamic" dejuicing is then employed in which the harvested grapes are moved along a grid, usually by an endless screw. Approximately 70 to 80% of the initial liquid content of the harvested grapes is removed by static dejuicing followed by dynamic dejuicing.

To extract more than this 70 to 80% of the juice, instead of further dejuicing an extremely vigorous mechanical pressing action is applied to the harvested grapes to obtain the so-called "press juice", as opposed to the so-called "juice from dejuicing" obtained by dejuicing.

The invention is directed to the production of a high-quality juice from dejuicing with a high yield using a simple and easy to use dejuicer.

SUMMARY OF THE INVENTION

The present invention proposes a dejuicer for harvested grapes embodying a closed tank provided with a dejuicer grid; a membrane disposed in the tank, which is adapted to be pressurized to force dejuicing of the harvested grapes through the grid; and conveyor means disposed in the tank to remove the dejuiced grapes from the tank.

When the dejuicer in accordance with the invention is employed by first allowing the juice to flow naturally and then by forcing the flow by means of the membrane, the final percentage extraction is comparable with that achieved by static dejuicing followed by dynamic dejuicing, that is to say a high yield.

By employing forced static dejuicing rather than dynamic dejuicing all of the juice is extracted without masticating the harvested grapes, the result of which is to produce a particularly clear, that is to say very high quality, juice.

The dejuicer in accordance with the invention is simple and convenient to use, not only because filling the tank and extracting the juice do not pose any problems but also because the dejuicer has built-in conveyor means which merely need to be actuated when all the juice extraction operations have been finished to remove the dejuiced grapes from the tank.

According to preferred features of the invention the conveyor means are disposed against a wall above which is the lowest part of the interior volume of the tank.

The harvested grapes introduced into the tank therefore cover the conveyor means, which are in the bottom part, the wall against which they are placed supporting the conveyor means to assist them to withstand, in addition to the weight of the harvested grapes, the additional force due to the pressurization of the membrane. The membrane is additionally isolated from the conveyor means by the harvested grapes so that there is no risk of it being damaged by the edges of the conveyor means. This arrangement of the conveyor means is, therefore, advantageous from the point of view of the reliability and the durability of the dejuicer.

According to other preferred features of the invention, the dejuicer includes dejuicing recovery means which communicate with the interior volume of the tank above the lowest part of the interior volume.

The juice in the tank up to a certain height above its lowest part will, therefore, not be recovered as juice from dejuicing, which is favorable to the quality of the juice obtained from dejuicing because it will not include the sediment usually found in the tank bottom.

According to other preferred features favorable to the simple, reliable and economical nature of the dejuicer the tank has an interior volume delimited by a solid wall above which is the lowest part of the interior volume of the tank; and by a dejuicer grid on each side above the solid wall, behind which is a juice from the dejuicing recovery chamber.

The conveyor means may embody one endless screw or two endless screws separated by a projecting portion of the wall.

The membrane forms a closed bag and is suspended from a rod disposed longitudinally in the upper part of the interior volume of the tank; the membrane is supplied with pressurizing agents through a hollow rod; and the membrane is elastic.

The invention also proposes a method of dejuicing harvested grapes using a dejuicer as defined above wherein the harvested grapes are placed in the tank; the juice is allowed to flow out naturally; the membrane is pressurized in the tank to force juice to flow through the grid; the membrane is depressurized; and the tank is emptied by actuating the conveyor means.

According to preferred features of the present invention, in some kinds of vinification, after the harvested grapes are placed in the tank they are allowed to macerate there before extraction of the juice is started.

This causes pellicular maceration which by virtue of the prolonged contact between the grape skin and the liquid enables extraction of important flavoring agents contained in the grape skin. With some types of grapes this further improves the quality of the juice obtained from dejuicing.

Objects, features and advantages of the invention will become apparent from a reading of a description of one embodiment thereof when taken in conjunction with the highly diagrammatic drawings appended hereto.

DETAILED DESCRIPTION OF THE PREFERRED EMBODIMENT

Figure 1:
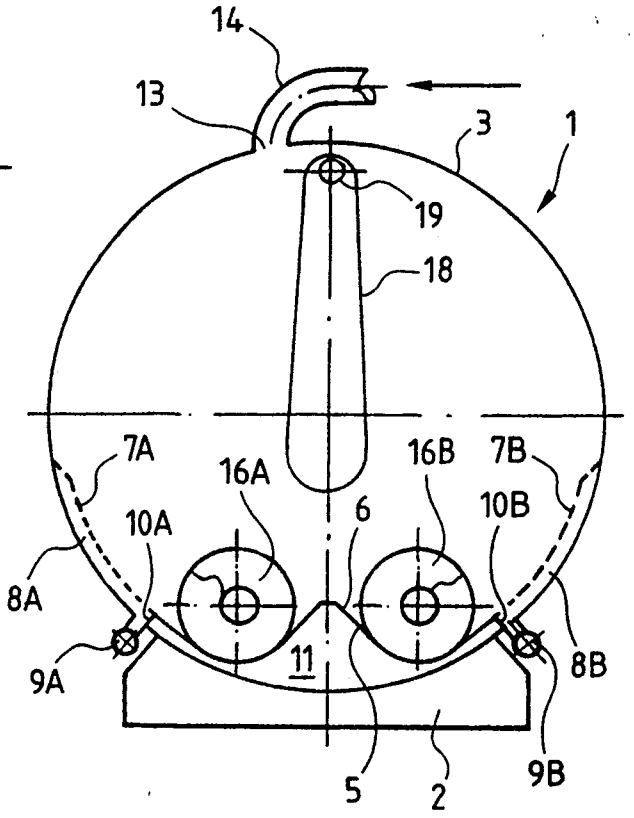
FIG. 1 is an elevational view in transverse cross section of an empty dejuicer in accordance with the invention.

As shown in the figures, a dejuicer according to the present invention has a generally cylindrical closed tank 1 with a horizontal axis and feet 2 resting on the ground.

The tank has a cylinder lateral wall 3 joined at each end to a respective transverse end wall 4A and 4B. A solid wall 5 delimiting two longitudinal channels separated by a protruding portion 6 is attached between the end walls 4A and 4B and above the lower portion of the wall 3, the lowest portion of the interior volume of the tank corresponding to the bottom of each of the channels. On each side of the wall 5, to a certain height, the interior volume of the tank is also delimited by a respective dejuicer grid 7A and 7B attached between the end walls 4A and 4B and substantially parallel to the lateral wall 3. Above the grids 7A and 7B the interior volume of the tank is delimited by the lateral wall 3. The space between the grids 7A and 7B and the lateral wall 3 defines chambers 8A and 8*b*, respectively, whose bottoms are connected to dejuicing recovery pipes 9A and 9B, respectively, each of which are fitted with a shut-off valve (not shown). Walls 10A and 10B isolate the chambers 8A and 8B, respectively, from the space 11 situated between the walls 3 and 5. At each end of the lateral channels delimited by the wall 5 is a trapdoor 12 in the wall 4A for removing the pomace. Two openings 13 in the upper part of the wall 3, for loading the harvested grapes, are each connected to a respective feed pipe 14. A trapdoor 15 is disposed substantially at the center of the wall 4A to provide access to the interior of the tank for installation and maintenance of its interior fittings.

Figure 2:
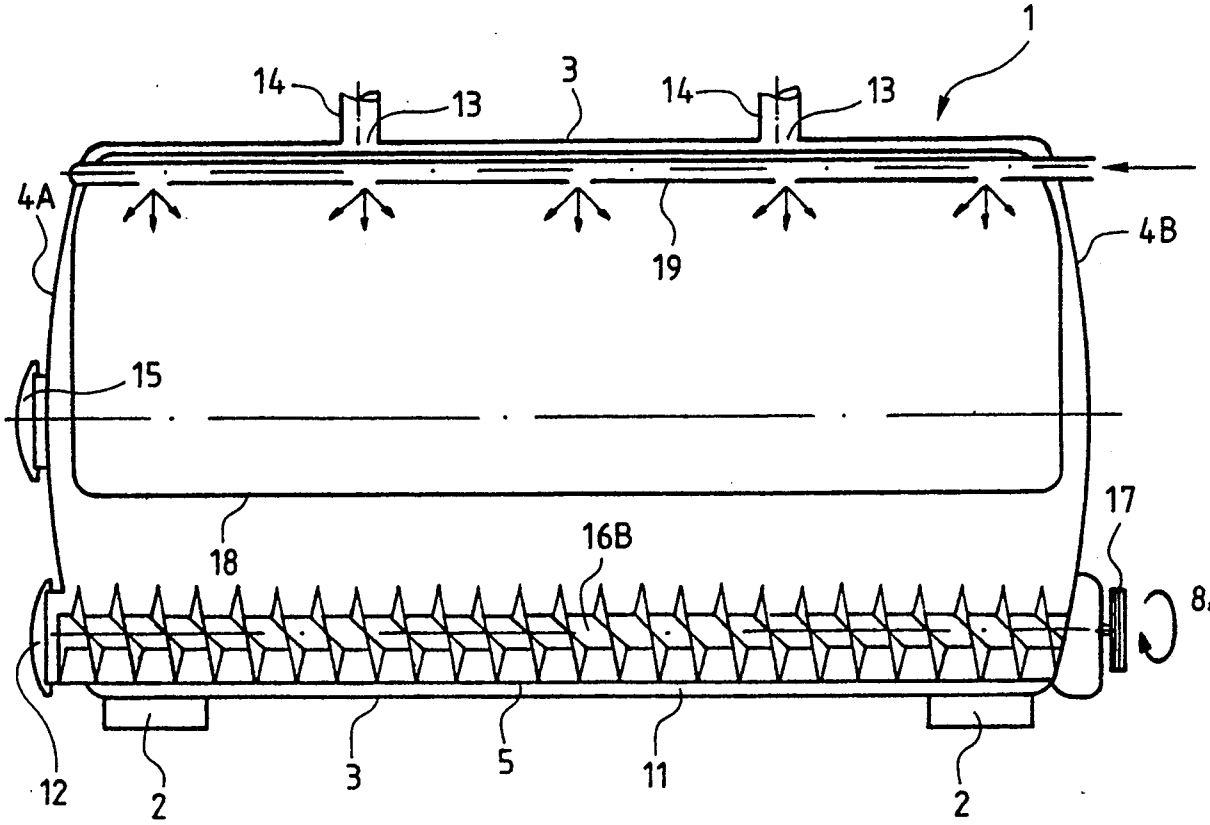
FIG. 2 is an elevational view in longitudinal cross section of the dejuicer.

Endless screws 16A and 16B are each located in a respective channel of the wall 5. At the same end of the tank 1 as the wall 4A, the endless screws 16A and 16B face the trapdoor 12. Each endless screw 16A and 16B has a shaft which extends beyond the wall 4B and is connected to a drive pulley 17 which is connected by a belt to a motor (not shown) and is adapted to rotate the endless screws 16A and 16B as shown by the arrow in FIG. 2.

A membrane 18, made from an elastic material in this embodiment, forms a closed bag and is suspended from a rod 19 disposed longitudinally in the upper part of the interior volume of the tank. The rod 19 is hollow (it is a tube) and supplies a pressurizing agent such as compressed air to the membrane. In this embodiment, (see FIG. 2) the rod 19 is inside the membrane 18 and is provided with five holes through which the pressurizing agent enters and leaves the membrane.

The operation of the dejuicer shown will now be described.

Figure 3:
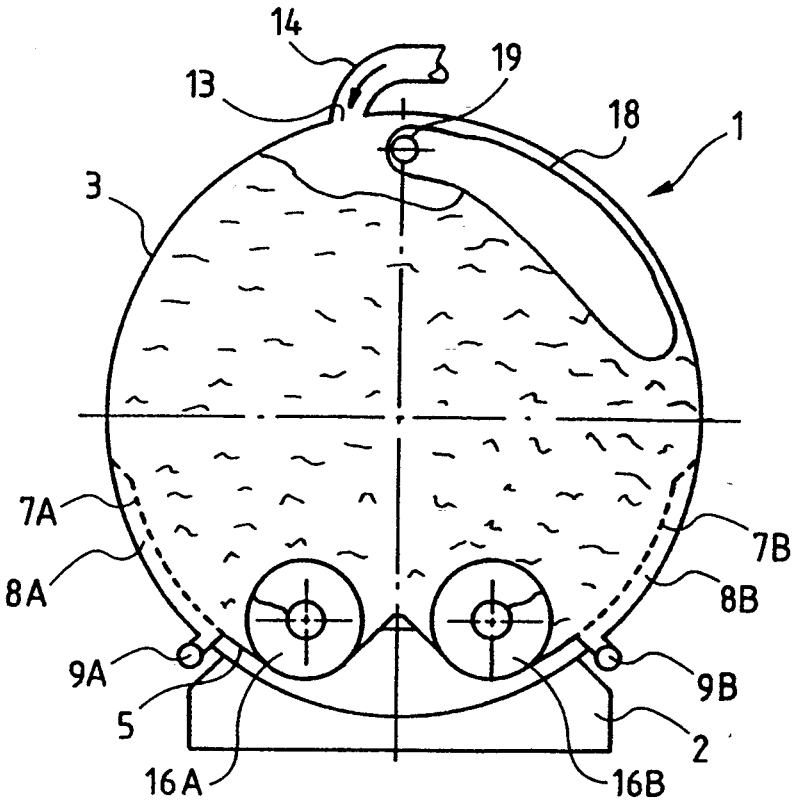
FIGS. 3 and 4 are views similar to FIG. 1, respectively, after the tank is filled with the harvested grapes and after the membrane is pressurized.

Starting with the tank 1 empty, as shown in FIG. 1, with the trapdoors 12 and 15 closed and the valves on the pipes 9A and 9B closed, the harvested grapes to be dejuiced are fed through the pipes 14 and the openings 13 into the interior volume of the tank 1 until they fill the tank, at the end of which operation the membrane 18 floats on top of the harvested grapes (see FIG. 3).

Either immediately, or after a few hours of maceration in the closed space, as defined by the interior volume of the tank, the removal of the resultant juice from the dejuicing extraction phase begins: the valves on the pipes 9A and 9B are opened and the resultant juice flows naturally, and after some time the flow rate decreases.

Figure 4:
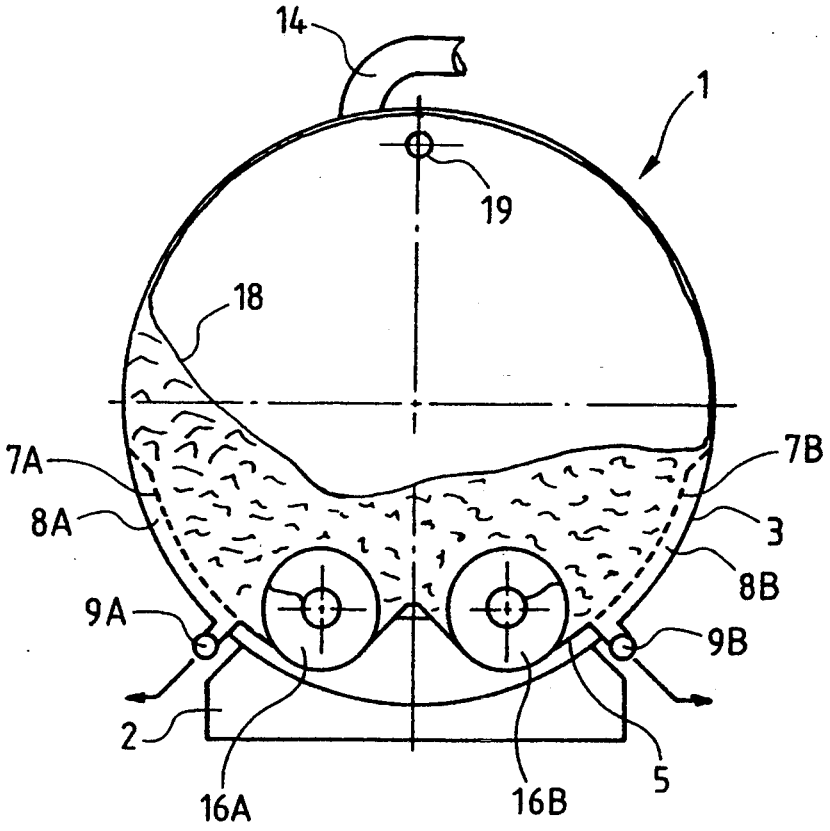

At this time, the pressurizing agent is fed into the membrane 18 causing it to inflate, and the grapes, already dejuiced naturally, are compressed (FIG. 4) which forces them to dejuice further, and the juice begins to flow again. After a while, the flow rate gradually decreases to zero and the compressed grapes block the grids 7A and 7B. This completes the juice extraction phase.

The membrane 18 is then depressurized, the trapdoors 12 are opened and the endless screws 16A and 16B are rotated to remove the dejuiced grapes, that is to say the pomace, from the tank. The membrane 18 reverts to its initial shape and position of its own accord because of its elasticity and because it is suspended from the rod 19.

Note that here the harvested grape feed openings 13 are offset to one side of the rod 19 which enables the membrane to remain above the harvested grapes (see FIG. 3).

In the example shown, it is beneficial to use two endless screws because of the diameter of the cylindrical wall 3, but in embodiments with different diameters a single endless screw or more than two endless screws may be used.

The endless screws function as conveyor means for the dejuiced grapes and are particularly suited to the dejuicer in accordance with the invention with regard to both ruggedness and efficiency. However, in some embodiments, especially of parallelepiped shape, the endless screws may be replaced with transverse bars driven by endless chains, scraping the bottom of the interior volume of the tank.

While the invention has been described in terms of a preferred embodiment, it is apparent that other forms could be adopted by one skilled in the art. Accordingly, the scope of the invention is to be limited only by the following claims.

What is claimed is:

1. A device for dejuicing harvested grapes and collecting the juice therefrom, said device comprising:

an immobile closed tank having a first end and an opposite end, said immobile closed tank further having an inner surface defining an internal chamber, said inner surface of said immobile closed tank having at least one feed opening located therein, said immobile closed tank further having at least one discharge opening located in said first end of said immobile closed tank;

at least one dejuicing grid spaced a predetermined distance from said inner surface of said immobile closed tank;

a membrane located within said internal chamber;

means for mounting said membrane separate from said inner surface of said immobile closed tank, said membrane further being adapted to be pressurized;

means for collecting said juice of said dejuiced grapes, said collecting means being located adjacent said dejuicing grid, said means for collecting receiving said juice from said harvested grapes; and means for removing said dejuiced harvested grapes from said immobile closed tank, said removing means being located within said immobil closed tank;

whereby after said harvested grapes are loaded into said internal chamber of said immobile closed tank through said at least one feed opening, said membrane is pressurized to apply pressure to said harvested grapes to dejuice said harvested grapes such that said juice flows through said at least one dejuicing grid and into said collecting means and whereafter said membrane is depressurized and then said removing means is actuated to remove said dejuiced harvested grapes from said immobile closed tank.

2. The device according to claim 1 wherein said immobile closed tank at said first end comprises a solid wall surrounding said at least one discharge opening and further wherein said means for removing said dejuiced harvested grapes is disposed adjacent said solid wall which is the lowest part of the interior volume of said immobile tank.

3. The device according to claim 2 wherein said means for collecting said juice from said dejuiced harvested grapes communicates with said internal chamber of said immobile closed tank.

4. The device according to claim 1 wherein said immobile closed tank at said first end comprises a solid wall defining the lowest part of the interior volume of said immobile closed tank; and further wherein said at least one dejuicing grid has a first lower end portion attached to said solid wall and a second opposite end portion attached to said inner surface of said immobile closed tank to define a dejuicing recovery chamber.

5. The device according to claim 1 wherein said means for removing said dejuiced harvested grapes comprises at least one endless screw.

6. The device according to claim 4 wherein said means for removing said dejuiced harvested grapes comprises two endless screws separated by a protruding portion of said solid wall.

7. The device according to claim 1 further comprising a hollow rod disposed longitudinally in the upper part of the interior volume of said immobile closed tank near said inner surface; and further wherein said membrane forms a closed bag having one end surrounding said hollow rod.

8. The device according to claim 7 further comprising means for pressurizing said membrane, said pressurizing means communicating with said membrane through said hollow rod.

9. The device according to claim 8 wherein said membrane is elastic.

10. A device for dejuicing harvested grapes, said device comprising:

an immobile closed tank defining an internal chamber having an inner surface, said immobile closed tank having provided internally a membrane and a conveyor means both located in said internal chamber, said internal chamber having at least one feed opening, a dejuicing grid and a discharge opening;

means for mounting said membrane separate from said inner surface of said internal chamber, said membrane being adapted to be pressurized so as to force juice from said harvested grapes, placed beforehand in said internal chamber, through said dejuicing grid;

said at least one feed opening being adapted to introduction of said harvested grapes in said tank directly into said internal chamber so that said harvested grapes can be placed in said chamber and then dejuiced through said dejuicing grid while said conveyor means remain inoperative;

said conveyor means being adapted to remove said harvested grapes from said immobile closed tank through said discharge opening; and said immobile closed tank being provided externally with feet for resting said immobile closed tank on the ground.

11. A dejuicer according to claim 10 further comprising a wall delimiting a lowermost portion of said internal chamber and further wherein said conveyor means is disposed against said wall in said lowermost portion of said internal chamber.

12. A dejuicer according to claim 11 wherein said wall has a protruding portion and further wherein said conveyor means comprises two endless screws separated by said protruding portion of said wall.

13. A dejuicer according to claim 10 further comprising juice recovery means which communicates with said internal chamber above a lowermost portion of said internal chamber.

14. A dejuicer according to claim 10 wherein said internal chamber further comprises:

a solid wall having a side, said solid wall defining a lowermost portion of said internal chamber; and wherein said dejuicing grid is located adjacent said side of said solid wall.

15. A dejuicer according to claim 10 wherein said conveyor means comprises at least one endless screw.

16. A dejuicer according to claim 10 further comprising a rod mounted longitudinally in said internal chamber and further wherein said membrane forms a closed bag and is suspended from said rod.

17. A dejuicer according to claim 16 wherein said rod is hollow and wherein said membrane is supplied with a pressurizing agent by said rod.

18. A dejuicer according to claim 16 wherein said membrane is elastic.

19. A dejuicer according to claim 16 wherein said at least one feed opening is offset with respect to said rod.

* * * * *